United States Patent [19]

Kochi et al.

[11] Patent Number: 4,819,133

[45] Date of Patent: Apr. 4, 1989

[54] REPLACEABLE HEADLAMP ASSEMBLY

[75] Inventors: Tadashi Kochi, Fuchu; Naotaka Sakamoto, Tokyo, both of Japan

[73] Assignee: Stanley Electric Co., Ltd., Tokyo, Japan

[21] Appl. No.: 243,159

[22] Filed: Sep. 9, 1988

Related U.S. Application Data

[63] Continuation of Ser. No. 169,941, Mar. 18, 1988, abandoned.

[30] Foreign Application Priority Data

Jul. 15, 1987 [JP] Japan ..... 62-176630

[51] Int. Cl.[4] ..... H01R 33/00

[52] U.S. Cl. ..... 362/61; 362/226; 313/318; 439/318

[58] Field of Search ..... 362/61, 80, 83, 226; 313/113, 318; 439/314, 318, 550

[56] References Cited

U.S. PATENT DOCUMENTS 3,947,081 3/1976 Peterson ..... 439/318 X
4,513,356 4/1985 Mikola ..... 313/318 X
4,590,542 5/1986 Schauwelrez et al. ..... 362/226 X
4,634,920 1/1987 Risclaert et al. ..... 313/113 X
4,682,274 7/1987 Freudenreich et al. ..... 362/226 X
4,703,989 11/1987 Price et al. ..... 439/314 X

FOREIGN PATENT DOCUMENTS 509334 11/1920 France ..... 362/61
2487950 2/1982 France ..... 362/61

*Primary Examiner*—Ira S. Lazarus
*Assistant Examiner*—Richard R. Cole
*Attorney, Agent, or Firm*—Frishauf, Holtz, Goodman & Woodward

[57] ABSTRACT

A replaceable headlamp assembly for use with a vehicle comprises a bulb socket and a locking member, wherein a flange of the bulb is held in position at the bulb socket by rotating the locking member. The locking member has a resilient section which snappingly engages over a key of the bulb socket to lock the locking member to the bulb socket while also permitting the locking member to rotate relative to the bulb socket over a given range. The locking member cannot be inadvertently disengaged form the bulb socket and therefore cannot be inadvertently lost or misplaced.

16 Claims, 3 Drawing Sheets

REPLACEABLE HEADLAMP ASSEMBLY

This application is a continuation of application Ser. No. 169,941, filed Mar. 18, 1988, now abandoned.

BACKGROUND OF THE INVENTION

1. Field of the Invention

The present invention relates to a handlamp assembly for replaceably mounting a headlamp of a vehicle such as an automobile.

2. Description of the Related Art

Shown in FIGS. 5 and 6 is an example of a conventional headlamp assembly 21 which comprises a bulb socket 22 and a locking member 23 both formed as a separate part thereof. The socket 22 substantially of a cylindrical shape is integrally formed with and at the rear of a reflector 11 of a handlamp. At the inner wall of the cylindrical socket 22 a bulb mount 22*a* is formed in such a shape that supports a shroud 31*a* of a bulb 31. At the outer wall of socket 22, three keys 22*b* are formed extending outward from the outer wall surface The locking member 23 substantially of a cylindrical shape has a top plate 23*a* with an opening 23*b* large enough to allow a rear shroud 31*b* of the bulb 31 to pass therethrough, and has three key retainers 23*c* with which the keys 22b are respectively engaged when the locking member 23 is mounted on bulb socket 22 and rotated in a predetermined direction. The bulb 31 is fixedly mounted within the assembly by holding a flange 31*c* between the bulb socket 22 and the locking member 23. A spring washer 24 and an O-ring 25 (FIG. 6) are used if necessary.

The above-described conventional headlamp assembly however has some problems. For example, first, it has recently become a tendency to adopt bulbs of the type having an L-shaped electrical connector extending at a right angle from the back of the bulb. Therefore, the conventional headlamp assembly cannot be applied to bulbs of this type because the locking member 23 cannot receive the bulb due to the shape of the electrical connector. Second, since the locking member 23 is readily removed from the bulb socket 22, it is likely to be lost during replacement of the bulb 31 by the user.

SUMMARY OF THE INVENTION

The above problems associated with a conventional replaceable headlamp assembly are solved by the present invention which provides a replaceable headlamp assembly for holding a flange of a bulb in position at a bulb socket by rotating a locking member, said bulb socket substantially of a cylindrical shape being formed at the rear of a reflector, and having at the inner wall thereof a bulb mount and at the outer wall a key extending outward from the outer wall surface, and said locking member of substantially a cylindrical shape having a top plate with an opening for passing a rear shroud of a said bulb socket, and a key retainer extending inward from the inner wall surface of said locking member for engagement with said key, said replaceable headlamp assembly further comprising:

a resilient section provided at part of said key retainer by forming slits in the cylindrical wall of said key retainer, said slits being radially spaced apart whereby said key is engaged with said key retainer by deforming said resilient section, and said bulb socket and said locking member are integrally assembled while allowing said locking member to rotate between a bulb setting or removing position and a bulb fixed position.

DETAILED DESCRIPTION OF THE INVENTION

The invention will be described in detail in conjunction with a preferred embodiment shown in the accompanying drawings.

In the embodiment of FIGS. 1–4, a replaceable handlamp assembly/according to the present invention comprises a bulb socket 2 and a locking member 3 which are mounted integrally after the assembly to the degree that they are hard to be disassembled without using a suitable jig. For ease of understanding, they are shown separately in FIG. 1 together with a halogen lamp or bulb 4, such as an HB3 type, HB4 type or the like bulb which is recently used in this field of technology and has a connector 4a and a flange 4*b* with three keys 4*c*.

Figure 2:
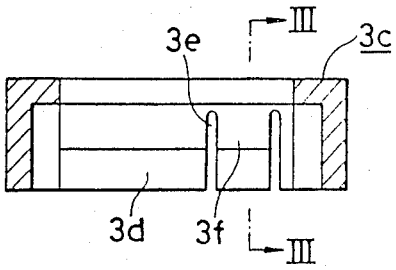
FIG.2 is a cross section taken along line II—II of FIG. 1.

At the inner wall of the bulb socket 2 of substantially a cylindrical shape, there is formed a bulb mount 2*a* having a shape adapted to receive the flange 4*b* of the bulb 4. At the outer wall thereof three keys 2*b* are formed extending outward from the outer wall surface. Also in a top plate 3*a* of the locking member 3 of substantially a cylindrical shape, an opening 3*b* is formed which has a shape adpated to receive the flange 4*b* of the bulb 4. At the outer wall thereof, key retaining sections 3*c* are formed extending outward and radially from the locking member 3. The key retaining sections 3*c* restrict the angular movement of the locking member 3 within a certain angle range while the latter is fittedly mounted over the bulb socket 2, due to the abutment of the keys 2*b* of the bulb socket 2 against respective opposite ends (to be described later) of the key retaining sections 3*c*. Thus, the angular movement presents two extremities, one corresponding to a bulb setting and removal position wherein the shape of the bulb mount 2*a* aligns with that of the opening 3*b*, and the other corresponding to a bulb fixing position (it is preferable in this case to set the fomer at the extremity in the counter-clock wise direction, and the latter at the other extremity, as analogous to the start and end of threading a screw). The inner side of one of the key retaining sections 3*c* is shown in FIG. 2. As understood from FIGS. 2 and 4, an inward extending key retainer 3*d* is formed at the inner wall of the key retaining section 3*c* over the entire lateral width thereof between both the above-described opposite ends. A resilient section 3*f* is provided at part of the key retaining section 3*c* by forming two vertical slits 3*e* laterally spaced apart by substantially the same width of the key 2*b* of the bulb socket 2. Three resilient sections 3*f*, although one section is shown in FIG. 2, are formed in correspondence with the three keys 2*b* of the bulb socket 2.

Figure 3:
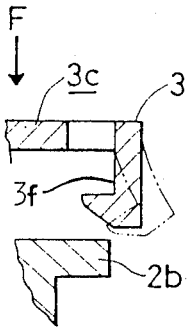
FIG. 3 is a cross section taken along line III—III of FIG. 2.
Figure 4:
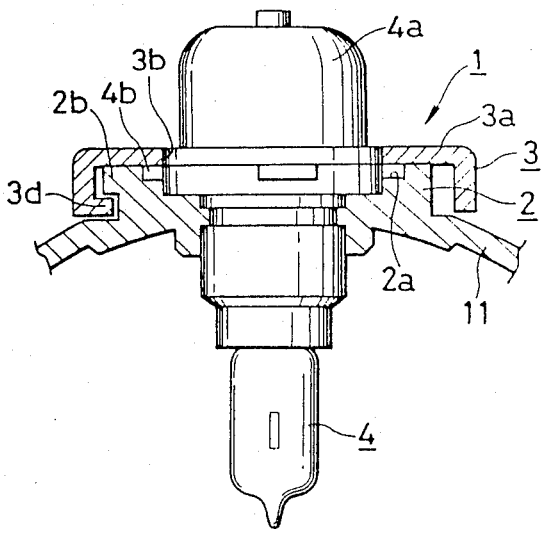
FIG. 4 shows the assembly partially in cross section wherein a bulb is mounted within the assembly.
Figure 5:
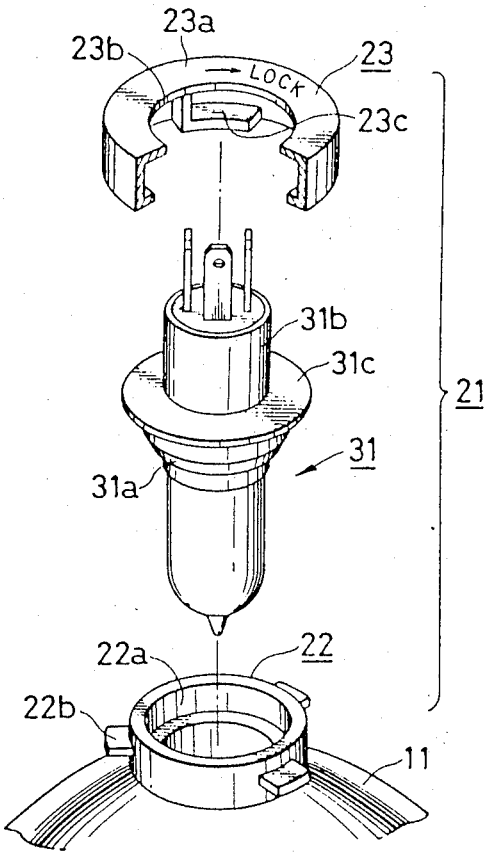
FIG. 5 (PRIOR ART)
FIG. 5 is a perspective view showng a conventional lamp assembly.
Figure 6:
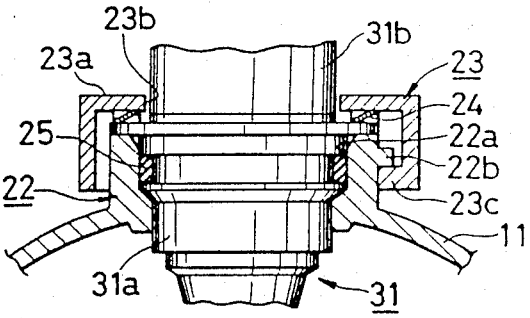
FIG. 6 (PRIOR ART)
FIG. 6 is a cross section showing the main part of the conventional assembly.

The operation of the resilient section 3*f* is illustratively shown in FIG. 3. By pressing the locking member 3 against the bulb socket 2, in the direction shown by an arrow F, with the keys 2*b* aligned with the resilient sections 3*f*, it becomes possible to engage the bulb socket 2 with the locking member 3 through deformation of the resilient section 3*f* as shown in dashed lines in FIG. 3, thus permitting resilient sections 3*f* to be snapped over respective keys 2*b*. Thus, both the bulb socket 2 and the locking member 3 become hard to be disassembled unless a proper jig or the like is used.

In order to mount a bulb 4 in the replaceable headlamp assembly 1 of this invention as constructed above, first by aligning the keys 2*b* with the resilient sections 3*f*, the locking member 3 is pushed down on to the bulb socket 2. Then in the bulb setting and removal position, the bulb 4 is inserted through the locking member 3 into the bulb socket 2 after correctly aligning the shape of the bulb mount 2*a* with that of the opening 3*b* so that the flange 4*b* of the bulb 4 is fittedly secured in the bulb socket by rotating the bulb 4. Thereafter, the locking member 3 is rotated in the clockwise direction to the bulb fixing position. In this case, by previously setting the depth of the bulb mount 2*a* and other dimensions, it is possible to allow a tight mounting of the bulb 4 within the assembly and prevent unnecessarily large clearances between parts.

Figure 1:
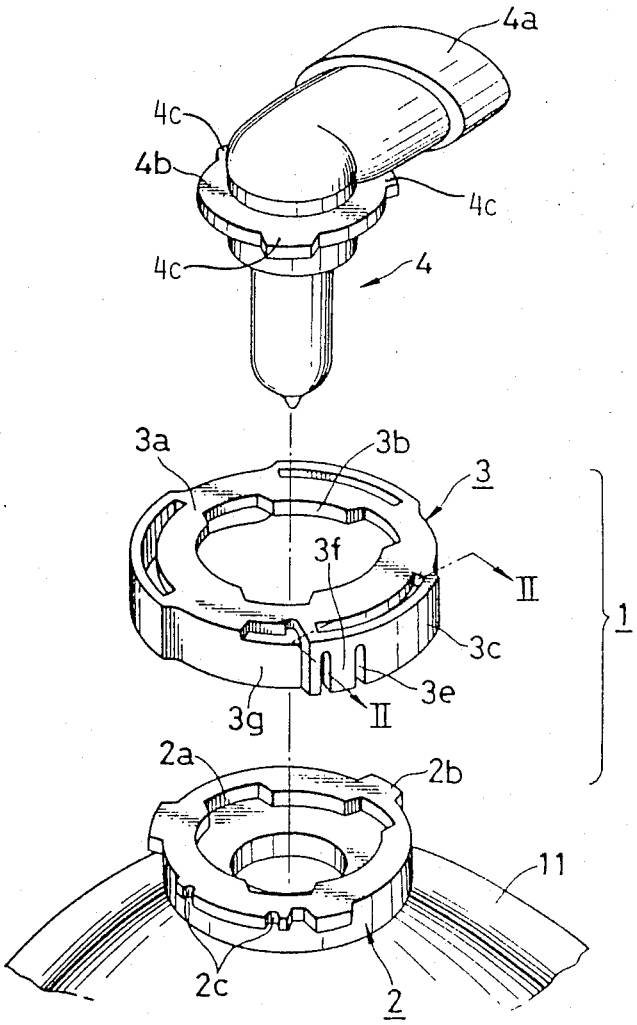
FIG.1 is an exploded perspective view of an embodiment of a replaceable lamp assembly according to the present invention.

Further, it is preferable to form click grooves 2*c* at the side wall of the bulb socket 2 as shown in FIG. 1 and a corresponding click spring 3*g* at the side wall of the locking member 3, thereby to conveniently notify the user of the bulb fixed position and the bulb setting and removing position by means of touch sense and click sounds during practical use.

As seen from the foregoing description of the replaceable headlamp assembly of this invention, a resilient section is provided at part of a key retainer of the locking member with the width thereof being the same as that of a key of the bulb socket, and the key retainer and the key are engaged with each other after deformation of the resilient section to thereby mount the locking member integrally with the bulb socket. Thus, irrespective of the configuration of a bulb having an L-shaped electrical connector for example, the assembly can find applications to various types of bulbs. Further, since separate parts are not present while replacing a bulb, the problem of losing parts can be advantageously solved.

What is claimed:

1. A replaceable headlamp assembly for holding a mounting portion of a replaceable bulb in position at a bulb socket by rotating a locking member relative to the bulb socket, comprising:

a bulb socket formed at a rear portion of a reflector, said bulb socket having a bulb mount at an inner wall thereof for receiving a mounting portion of replaceable bulb, said bulb socket having at least one key extending outwardly from an outer wall thereof; and a substantially cylindrical locking member including a member having an opening therein for permitting said mounting portion of said bulb to pass therethrough, means for lockingly engaging said mounting portion of said bulb, and at least one key retainer means facing inwardly from an inner wall of said locking member for engagement with a respective one of said at least one key of said bulb socket;

each of said key retainer means comprising:

a substantially cylindrical wall section, and a resilient section formed in said substantially cylindrical wall section, said resilient section being engageable with a respective one of said at least one key of said bulb socket and being resiliently deformable responsive to engagement with said respective at least one key for snapping over said at least one key for lockingly engaging said locking member with said bulb socket such that said locking member is rotatable relative to said bulb socket over a given range, said bulb socket and said locking member being thereby integrally assembled together with said locking member being rotatable relative to said bulb socket between a bulb setting and removing position at which a bulb can be set or replaced, and a bulb fixing position at which a bulb is fixed to said bulb socket by said locking member.

2. The replaceable headlamp assembly of claim 1, wherein said resilient section comprises at least two spaced apart slits in said substantially cylindrical wall section of said key retainer means.

3. The replaceable headlamp assembly of claim 2, wherein said slits are spaced apart a distance substantially equal to the width of said at least one key of said bulb socket in a circumferential direction.

4. The replaceable headlamp assembly of claim 1, further comprising click-stop means provided on at least one of said bulb socket and said locking member for indicating at least one of said bulb setting and removing position, and said bulb fixing position.

5. The replaceable headlamp assembly of claim 4, wherein said click-stop means includes means for audibly indicting at least one of said positions.

6. The replaceable headlamp assembly of claim 5, wherein said click-stop means includes means for indicating at least one of said positions by feel.

7. The replaceable headlamp assembly of claim 4, wherein said click-stop means includes means for indicating at least one of said positions by feel.

8. The replaceable headlamp assembly of claim 4, wherein said resilient section is resiliently deformable in an outward direction of said locking member.

9. The replaceable headlamp assembly of claim 8, wherein said resilient section includes cam means for facilitating engagement with said respective key.

10. The replaceable headlamp assembly of claim 9, wherein said resilient section includes locking means for preventing disengagement from said respective key after engagement therewith.

11. The replaceable headlamp assembly of claim 1, wherein said resilient section includes cam means for facilitating engagement with said respective key.

12. The replaceable headlamp assembly of claim 1, wherein said resilient section includes locking means for preventing disengagement from said respective key after engagement therewith.

13. The replaceable headlamp assembly of claim 1, wherein said mounting portion of said bulb includes a flange which is engageable between said bulb socket and locking member when said locking member is rotated to its bulb fixing position.

14. The replaceable headlamp assembly of claim 13, wherein said flange has at least one key extending outwardly therefrom.

15. The replaceable headlamp assembly of claim 14, wherein said bulb socket and locking member have respective openings which are alignable for permitting said at least one key of said flange to pass therethrough.

16. The replaceable headlamp assembly of claim 15, wherein, when said locking member is rotated to its bulb fixing position, said at least one opening therein is out of alignment with the opening of said bulb socket, whereby said flange is locked to said bulb socket in said bulb fixing position.

* * * * *

UNITED STATES PATENT AND TRADEMARK OFFICE

CERTIFICATE OF CORRECTION

PATENT NO. : 4,819,133

DATED : April 4, 1989

INVENTOR(S) : KOCHI et al

It is certified that error appears in the above-identified patent and that said Letters Patent is hereby corrected as shown below:

Column 1, line 22, change "wall surface The" to read

--wall surface thereof. The--.

Column 2, line 26, change "assembly/according" to read

--assembly 1 according--.

Signed and Sealed this

First Day of June, 1993

*Attest:*

Michael K. Kirk

MICHAEL K. KIRK

*Attesting Officer*

*Acting Commissioner of Patents and Trademarks*